United States Patent [19]

Koch

[11] Patent Number: 4,986,335

[45] Date of Patent: Jan. 22, 1991

[54] DIES FOR HORIZONTAL-VERTICAL DIE CASTING MACHINES

[75] Inventor: Byron W. Koch, Toledo, Ohio

[73] Assignee: Farley, Inc., Chicago, Ill.

[21] Appl. No.: 522,794

[22] Filed: May 14, 1990

[51] Int. Cl.[5] ..... B22D 17/12; B22D 17/26; B22D 17/30

[52] U.S. Cl. ..... 164/312; 164/342; 164/343

[58] Field of Search ..... 164/312, 314, 341, 342, 164/343

[56] References Cited

U.S. PATENT DOCUMENTS

| | | | |
|---|---|---|---|
| 4,655,274 | 4/1987 | Dannoura | 164/342 X |
| 4,690,197 | 9/1987 | Dannoura | 164/312 |
| 4,741,379 | 5/1988 | Dannoura | 164/312 |
| 4,799,534 | 1/1989 | Ueno et al. | 164/312 X |
| 4,836,267 | 6/1989 | Ueno et al. | 164/312 X |

FOREIGN PATENT DOCUMENTS

| | | | |
|---|---|---|---|
| 63-256257 | 10/1988 | Japan | 164/312 |
| 63-273559 | 11/1988 | Japan | 164/312 |

*Primary Examiner*—Richard K. Seidel
*Assistant Examiner*—J. Reed Batten, Jr.
*Attorney, Agent, or Firm*—Hugh Adam Kirk

[57] ABSTRACT

A stationary die for a horizontal die casting machine has an oscillatable molten metal injector below the die that oscillates from an acute angle outside the die for filling with molten metal to an acute angle under the die or injecting the molten metal into the die. The stationary die has an annular docking block at the same acute angle to the horizontal as the axis of the shot sleeve under the die. The edge of the aperture at the outer end of the docking block is adjacent to and substantially in the plane of the parting surface of the stationary die so that the docking block per se projects outwardly from the surface. Correspondingly, the adjacent parting surface of the movable die is provided with a cavity for fitting this projection of the docking block, but since the surfaces of this docking block are at convergent acute angles, they provide no restriction to the movement of the movable die. A trough duct is provided in the stationary die from the open end aperture of the docking block to the die cavity for the molten metal for producing the casting between the closed dies. Ejector pins are provided for removal of the casting after it has been cast and the dies parted. Furthermore, the movable die may be provided with one or more slides, including a slide adjacent the docking block with a cavity therein for receiving the outward projecting part of this block from the surface of the stationary die.

20 Claims, 7 Drawing Sheets

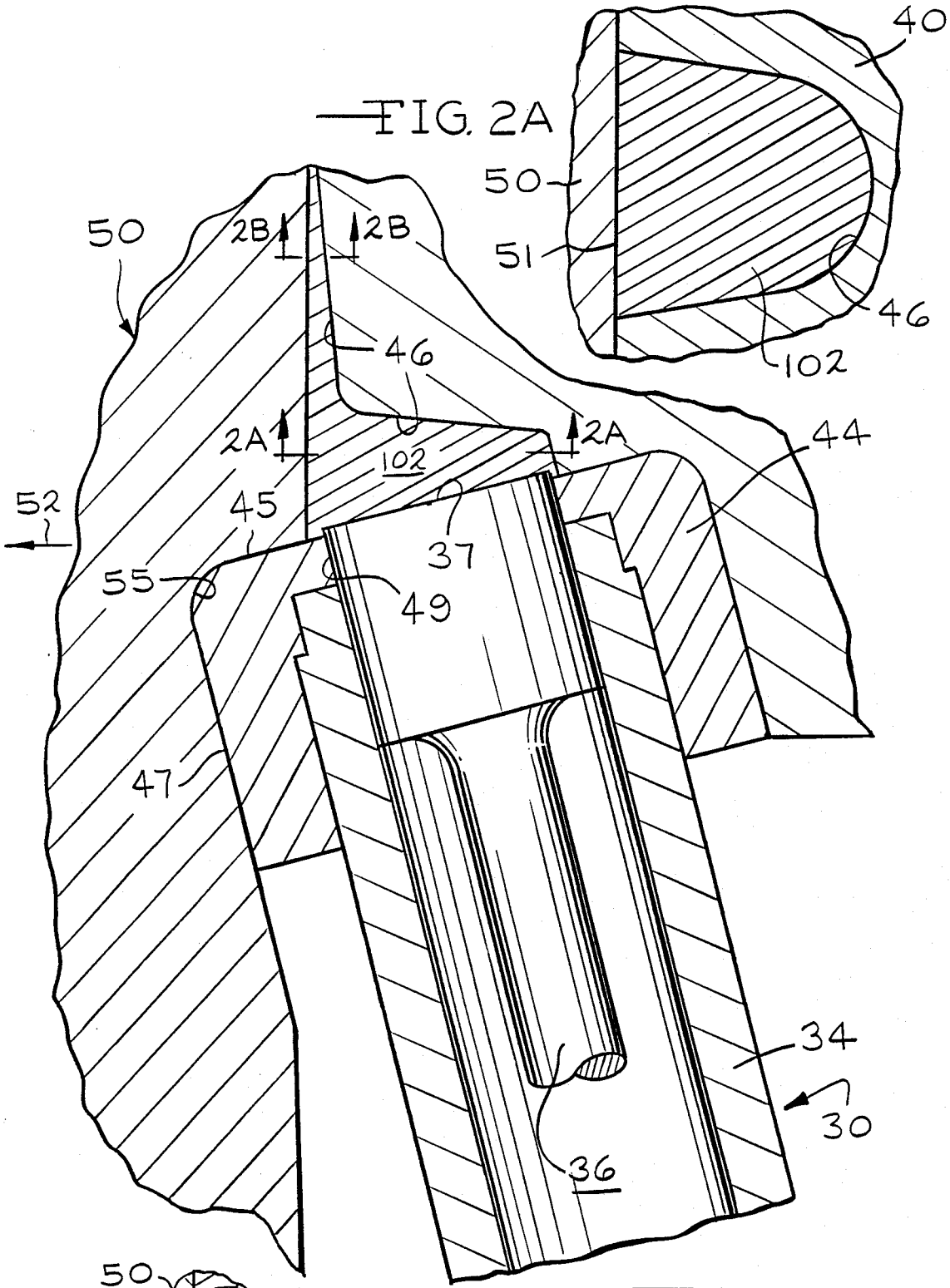
FIG. 2A
FIG. 2
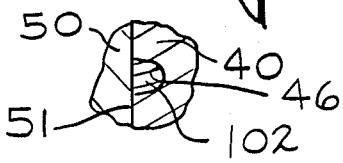
FIG. 2B

DIES FOR HORIZONTAL-VERTICAL DIE CASTING MACHINES

BACKGROUND OF THE INVENTION

This invention is an improvement for U.S. Pat. No. 4,741,379 of Dannoura issued May 3, 1988 and assigned to UBE Industries, Ltd. This patent discloses a horizontal movable die in a casting machine with an oscillatable vertical injector under the dies, which injector cooperates with a split docking block shared between the parting surfaces of the stationary and movable dies.

SUMMARY OF THE INVENTION

Generally speaking, the dies of this invention, and particularly the stationary die, is for a horizontal movable die casting machine having a vertical injector beneath the stationary die, which injector may oscillate, rock or swing from a molten metal filling position out from under the stationary die to a molten metal die injection position under the stationary die. The angle of rocking or oscillating the injector mechanism is usually about 15° either side of the vertical.

The docking block seats the shot sleeve on the outer upper end of the injector during filling of the die with molten metal. This docking block is an integral unsplit annular bushing that is embedded in the lower part of the parting surface of the stationary die so that the edge of the opening or aperture at the outer upper end of the docking block is in the plane of the parting surface of the stationary die. Thus this docking block bushing projects outwardly from the stationary die parting surface into a corresponding cavity in the adjacent surface of the movable die, but the projecting part of the bushing preferably has only convergent angular surfaces so as to form no obstruction for the retraction of the movable die. Similarly, the injecting piston in the shot sleeve extends through and slightly beyond the outer surface of the aperture in the docking block, so that when this piston retracts, this aperture will not be an obstruction to the retraction of the movable die.

There is a trough duct in the stationary die which forms the sprue of the casting, which duct extends from the whole aperture at the open end of the docking block or bushing to the casting. This trough has all its sides converge away from the parting surface of the sationary die so the sprue is removed easily from the stationary die after the casting is made and after the piston of the shot sleeve has been retracted.

If desired, the movable die may have a plurality of slides, including a vertically movable slide adjacent the docking block. This latter slide has in its parting surface a cavity for the annular bushing at the end of the docking block, similar to the cavity in the parting surface in the movable die above mentioned. The movable die preferably is provided with ejector pins for removing the casting from the movable die after the casting has been formed and dies and slides have been parted.

OBJECTS AND ADVANTAGES

It is an object of this invention to produce a simple, efficient, effective, and economic stationary die with a complete annular docking block in its parting surface for a vertical injector of a die casting machine.

Another object is to produce a docking block or bushing in a stationary die of a die casting maching which does not gall due to misalignment of the shot sleeve and docking block, reduces wear, avoids leakage of molten metal, and produces a sprue that is easily removed from the die.

Still another or further object is to provide a movable die in a horizontal die casting machine that can have a plurality of movable slides, including one adjacent the docking block in the stationary die, enabling production of complex die castings, including V-type engine blocks.

BRIEF DESCRIPTION OF THE DRAWINGS

The above mentioned and other features, objects and advantages, and a manner of attaining them, are described more specifically below by reference to embodiments of this invention shown in accompanying drawings wherein:

FIG. 2 is an enlarged vertical sectional view of the docking block, with the shot sleeve and piston of the injector extended fully therein in the stationary die, and showing the sprue formed therefrom between the stationary die and the horizontal movable die;

FIGS. 2A and 2B are sections along 2A—2A and 2B—2B of FIG. 2 showing the tapered sides of the duct that forms the sprue;

DETAILED DESCRIPTION OF PREFERRED EMBODIMENTS

Figure 1:
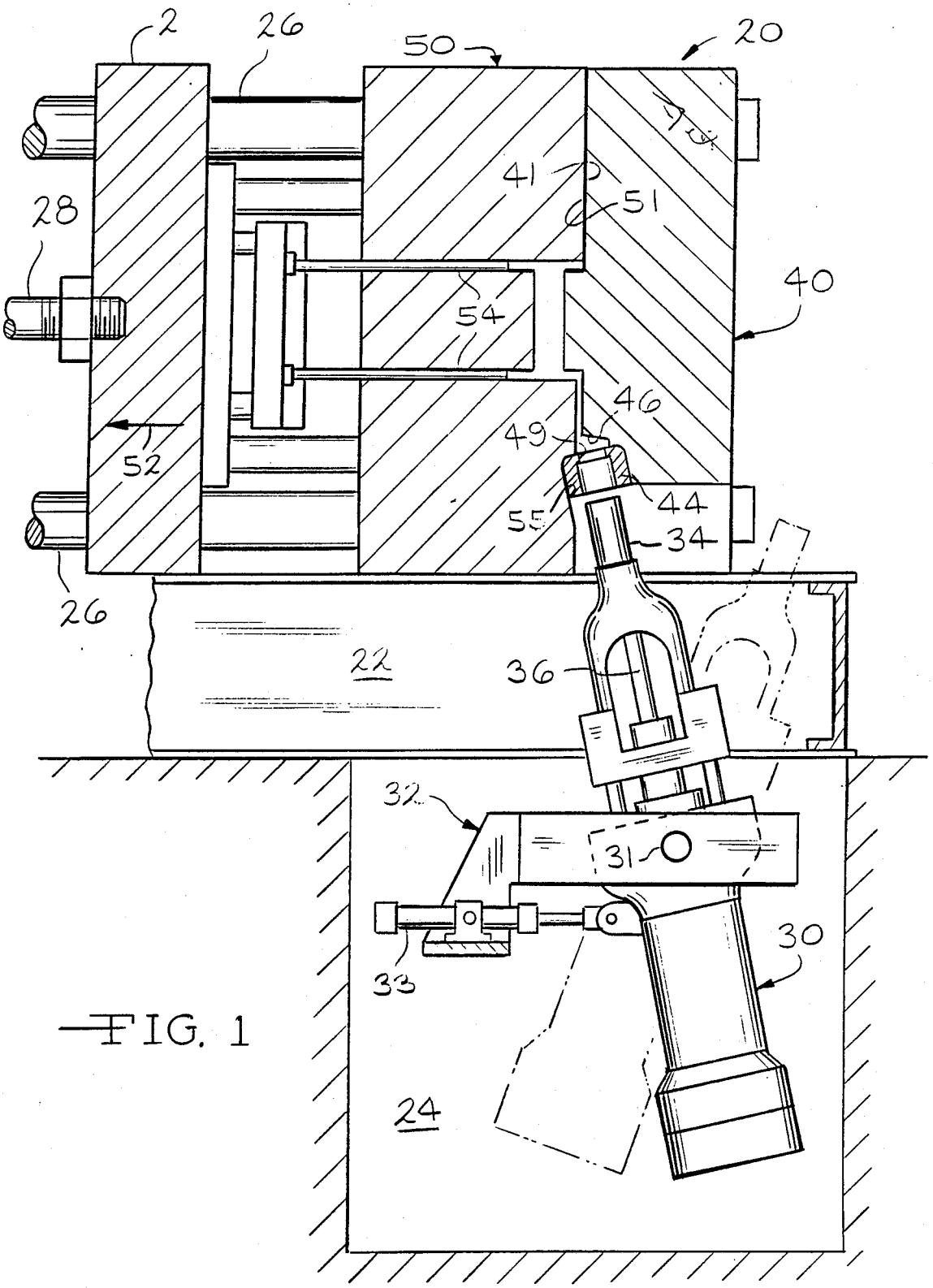
FIG. 1 is a side elevation of the die casting die part of a horizontal die casting machine having a vertical rockable or oscillatable molten metal injector mounted below the die, said die being shown in vertical section incorporating a docking block in th parting surface of the stationary die according to a preferred embodiment of this invention.
Figure 3:
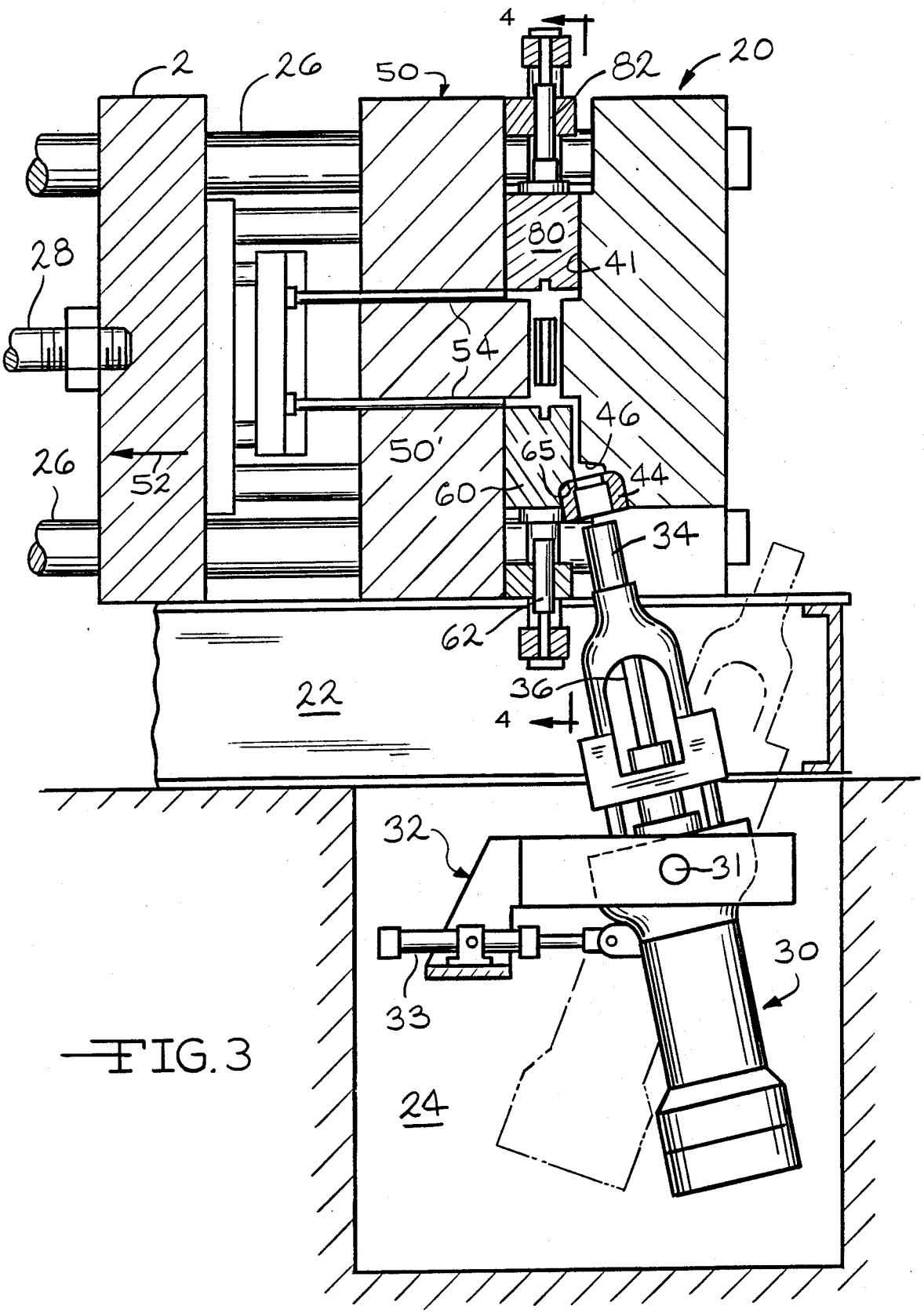
FIG. 3 is a view similar to FIG. 1 wherein the movable die is provided with a plurality of slides showing herein opposite vertical slides.
Figure 4:
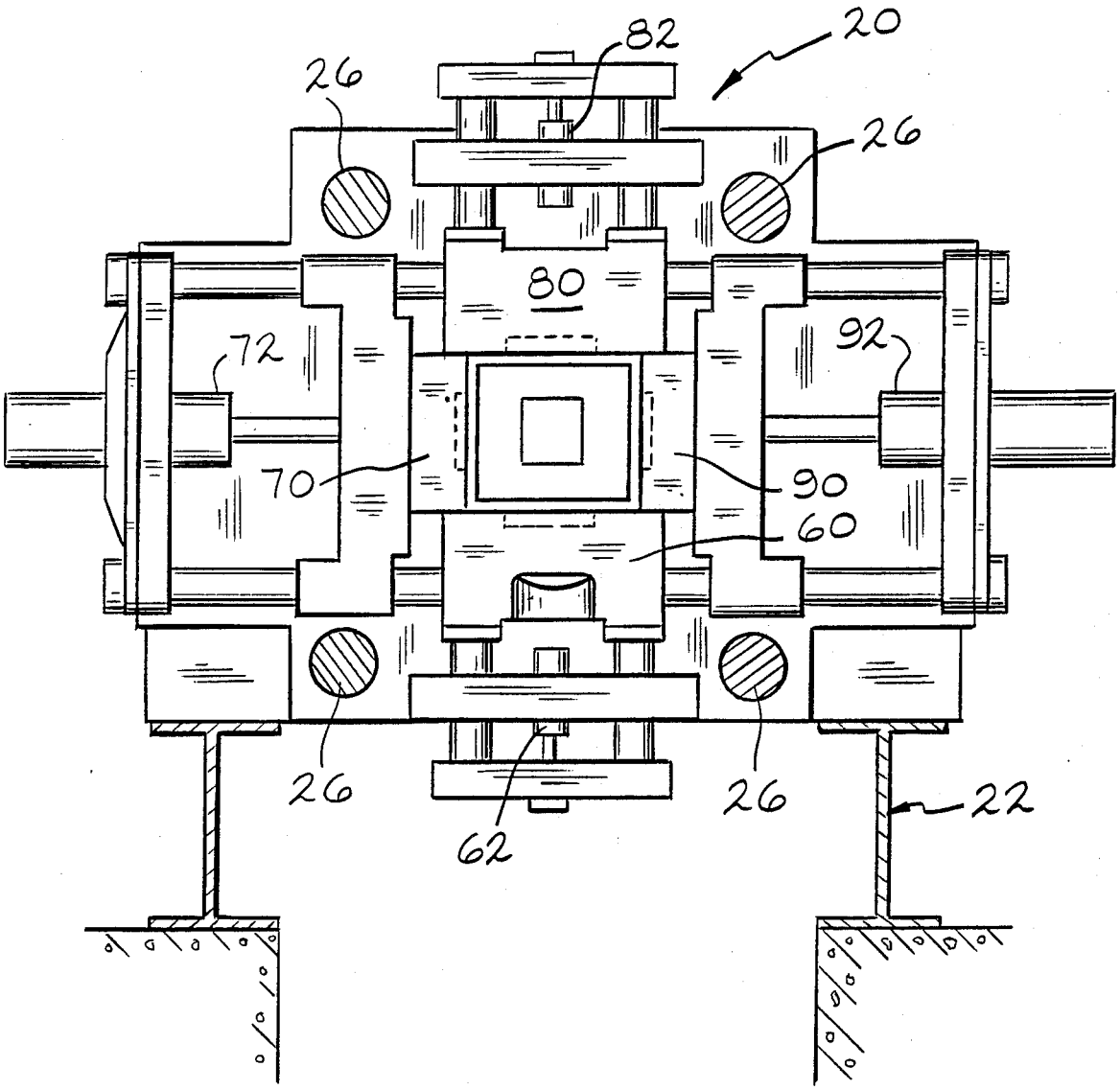
FIG. 4 is a sectional view taken along line 4—4 of FIG. 3 showing the movable die with four orthogonal slides.

Referring first to FIGS. 1 and 3, there is shown the die portion of a horizontal die casting machine 20 mounted on a base 22 over a pit 24. In the pit 24 is a vertical oscillating molten metal injector device 30 below the stationary die 40 of the machine 20. The movable die 50, which engages the stationary die 40 at their parting surfaces 51 and 41, respectively, is slideable along the rail rods 26 by action of the piston rod 28 threadedly anchored to the movable platen 29 that carries the movable die 50, 50'.

The substantially vertical molten metal injector device or mechanism 30 is shown mounted on a bracket 32 in the pit 24 by means of a pivot 31. This injector 30 may be rocked or oscillated from its full line molten metal injecting position into its dotted-line molten metal filling position, by means of a reciprocating motor 33, such as a hydraulic cylinder and piston, also mounted on bracket 32. At the upper end of the injector mechanism 30 there is shown in FIGS. 1, 2, 3 and 5 a shot sleeve 34 inside of which is a piston 36 (see FIG. 2) for injecting the liquid metal, that has been poured into the shot sleeve when in its dotted-line position shown in FIGS. 1 and 3. The piston forces the molten or liquid metal into the cavity in the mold or dies 40 and 50 to form a casting 100 (see FIGS. 5 through 8 and 10).

Referring now to the stationary die 40, there is shown mounted in its lower portion and parting surface 40 a docking block 44 into which the shot sleeve 34 extends as shown in FIG. 2 for connecting the injector with the stationary or fixed die 40 for injecting the molten metal into the dies through the sprue cavity or trough 46. This trough 46 has divergent tapered sides similar to that between the end ofthe docking block 44 with its adjacent opposite side shown in FIGS. 1, 2 2A and 2B for easy separation of the movable die 50 in the direction of the arrows 52. This easy removal may also be provided by the angle of the surface 45 at the outer end of the docking block 44 and its cylindrical side wall 47. There is provided a corresponding cavity 55 for the outward projecting surfaces 45 and 47 from the contacting surface 41 of the movable die 50. Thus the relatively small projection of the docking block 44 or its outer end annular bushing out from the parting surface 41 of the stationary die 40 permits a continuous cylindrical integral annular docking block 44 for the end of the shot sleeve 34 in the statinary die. This structure reduces the chances of leakage, misfits, scoring, and wear between the docking block 44 and shot sleeve 34. As shown in more detail in FIG. 2, the outer end 37 of the piston 36 in the shot sleeve 34 preferably extends very slightly beyond the planar surface 45 of the docking block so that when the piston 36 is retracted as shown in FIGS. 1 and 3, there will be no obstruction for the motion of the movable die 50 in the direction of the arrows 52. This insures that no sprue or part thereof will be caught behind the aperture 49 in the docking block 44 through which aperture the molten metal is forced by the piston 36.

Referring now to FIGS. 3 through 10, there is disclosed another embodiment of this invention in which the movable die 50' is provided with at least one slide 60 in its lower parting surface adjacent the docking block 44 in the stationary die 40. This slide 60 has a corresponding cavity 65 to that of cavity 55 for the projecting annular part of the docking block 44. This slide 60 is shown to be vertically movable by means of reciprocating hydraulic motor 62.

Shown in FIGS. 3 through 10 are three other slides opposite and orthogonal to slide 60, namely slides 70, 80, and 90, respectively, with separate reciprocating motors 72, 82 and 92 for extending and retracting each slide. This movable die 50' with these four slides is similar to the movable die 50 without slides, and has the same horizontal reciprocal motion and means for moving the same as disclosed for the movable die 50 shown and described above in combination with FIG. 1. It should be understood that slides at other angles to the horizontal than orthogonal may be employed in the dies 40 and/or 50 without departing from the scope of this invention.

Figure 8:
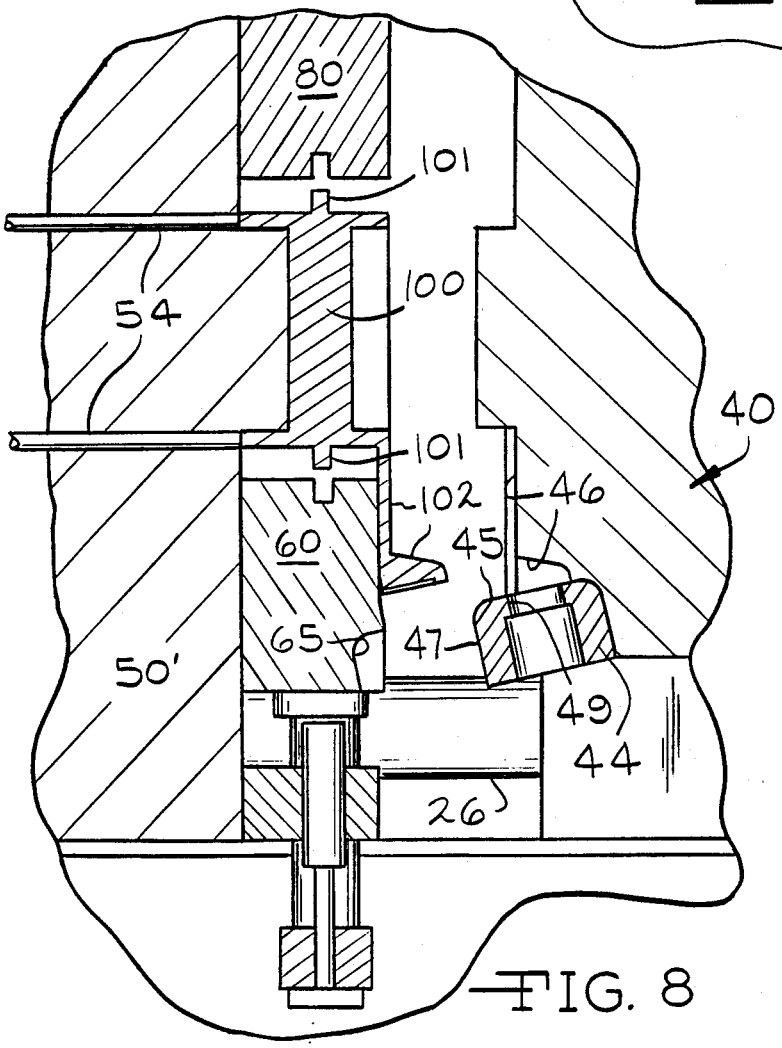
FIG. 8 is similar to FIG. 7 with the slides retracted.
Figure 10:
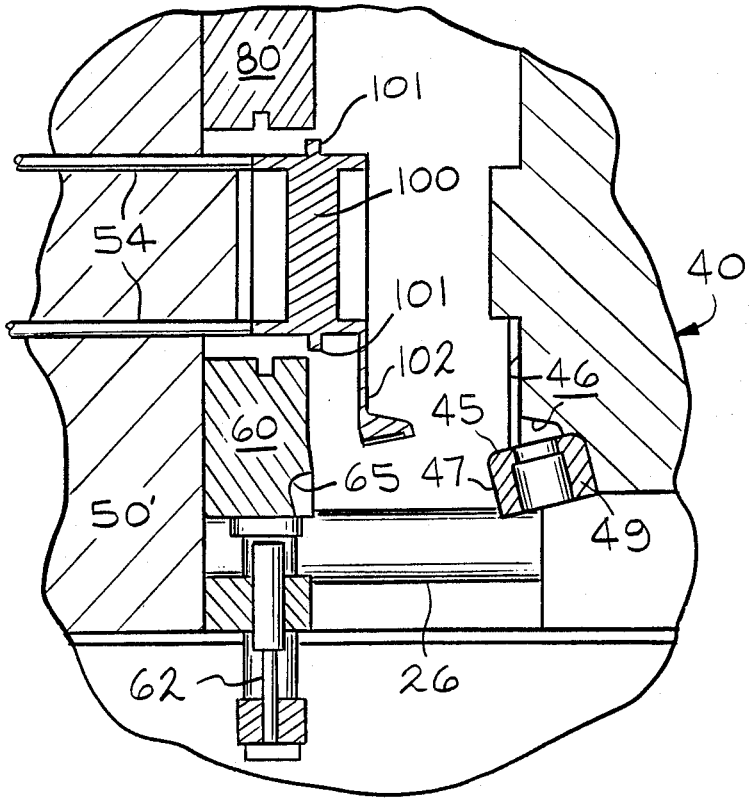
FIG. 10 is similar to FIG. 8 with the ejector pins ejecting the casting and its sprue from the movable die.

The purpose of the slides enable additional configurations, projections, and depressions, such as projecitons 101, to be formed on the casting 100 (see FIGS. 8 and 10). This enables more complicated castings to be made. Furthermore, the stationary die 40 of this invention with its integral docking block 44 permits installation and operation of a bottom vertical slide 60 without interference with the injector mechanism 30 or its docking block 44. In this respect, even internal combustion V-engine blocks can be produced with the dies of this invention.

Although ejector pins 54 are only shown in the movable die 50 or 50', they also may be placed, if necessary, into the stationary die 40.

Figure 5:
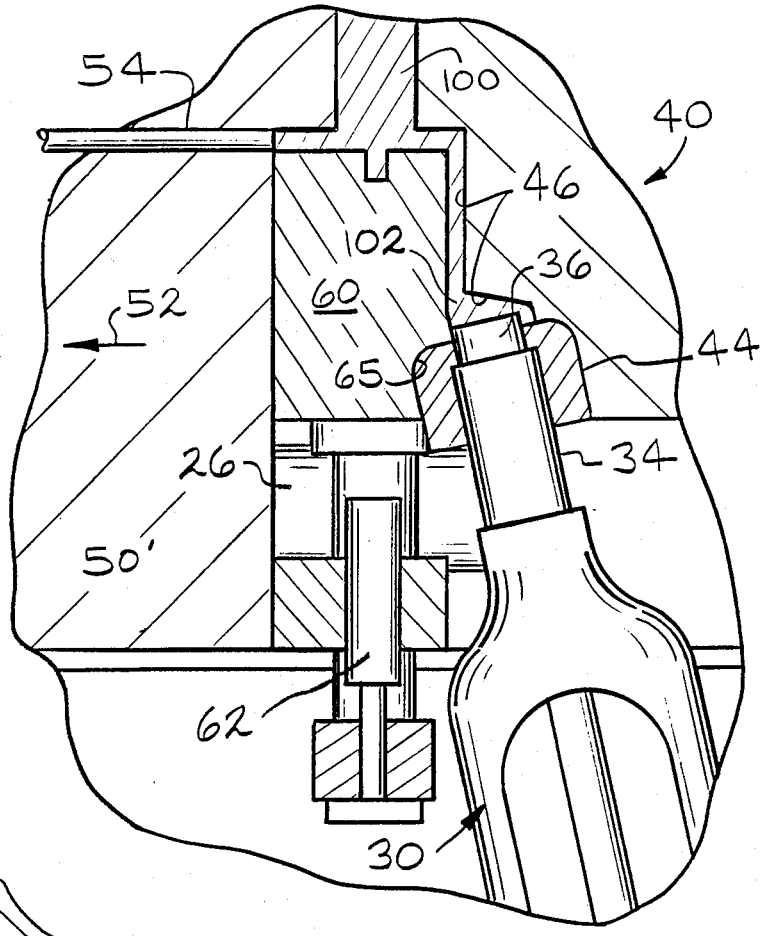
FIG. 5 is an enlarged sectional view of the docking block in the stationary die and bottom movable slide in the adjacent movable die as shown in FIG. 3 with the slides and dies closed, the shot sleeve and piston of the injector extended and the casting sprue and part of the casting filled with molten metal.
Figure 6:
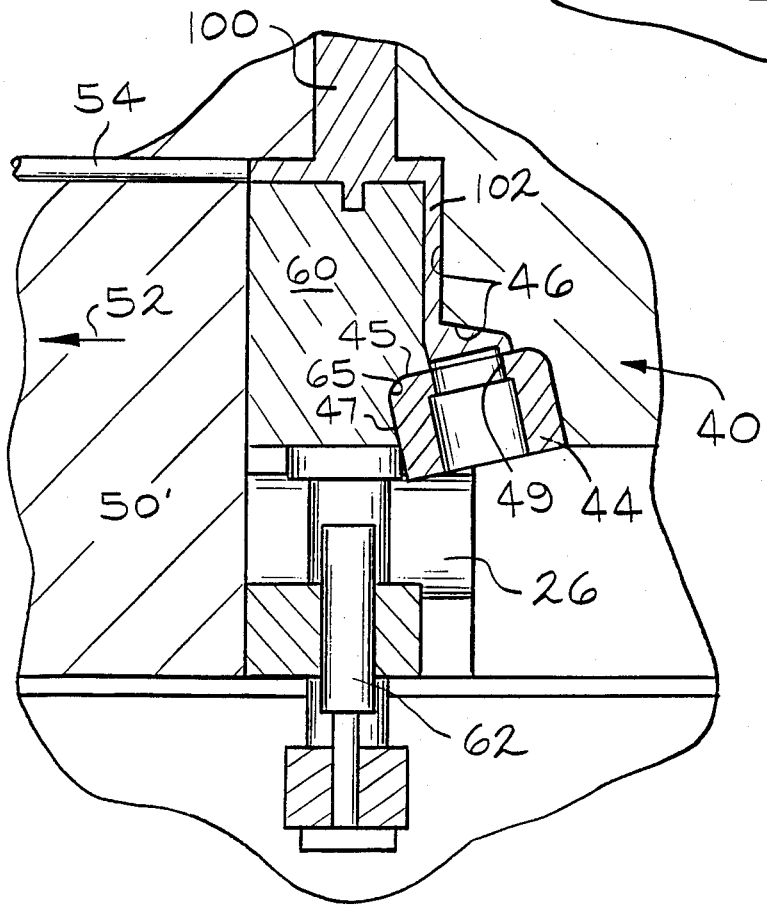
FIG. 6 is similar to FIG. 5 with the injector retracted and removed.
Figure 7:
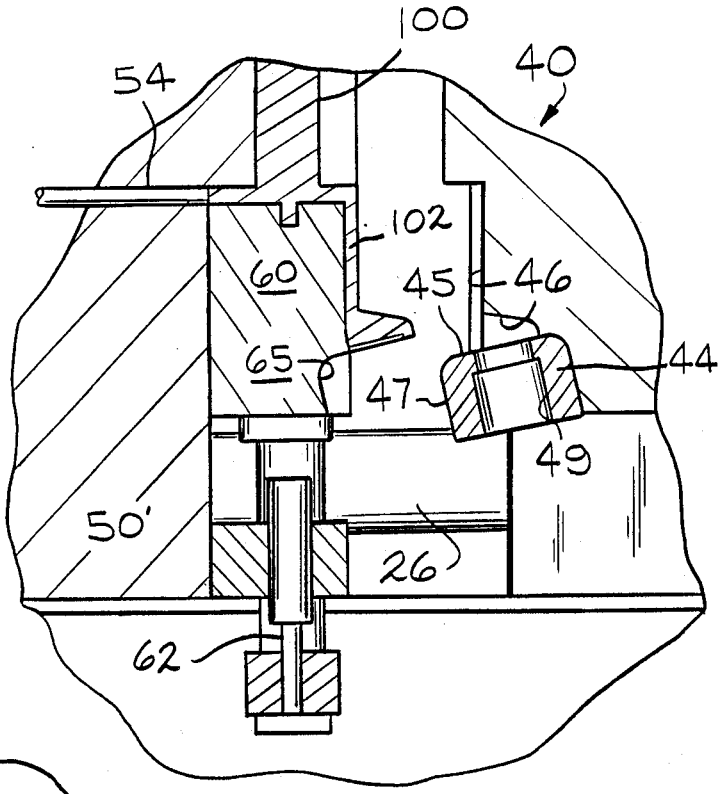
FIG. 7 is similar to FIG. 6 with the movable die with the slide moved away from the stationary die.
Figure 9:
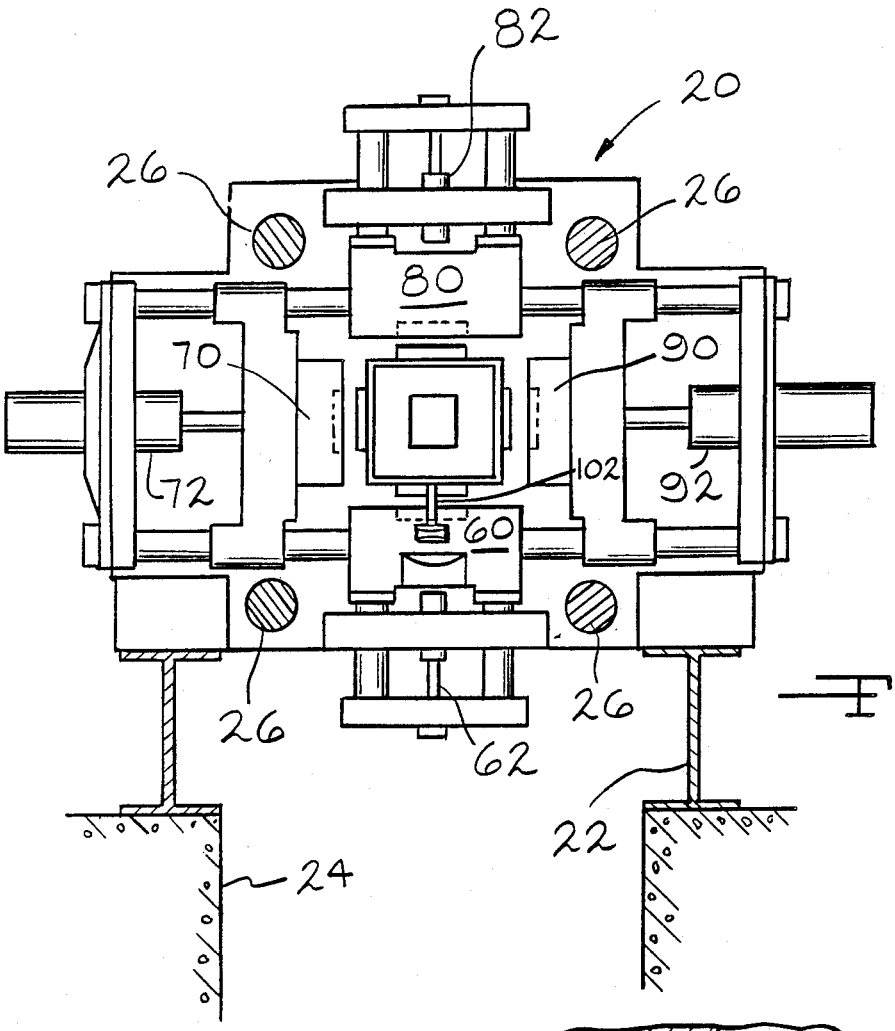
FIG. 9 is a view similar to FIG. 4 but reduced in size with all four of the slides being retracted.

Following through an operation of the dies 40 and 50 or 50' of this invention in a horizontal die casting machine with a vertical injecting device 30, the slides 60, 70, 80 and 90 are usually closed first while the movable die 50' is open. Then the movable die 50' or 50 is closed so that its parting surface 51 is in contact with the parting surface 41 of the stationary, cover or fixed die 40 as shown in FIGS. 1, 3, and 5. In the meantime, the injector mechanism 30 may be tilted in its dotted-line position as shown in FIGS. 1 and 3, and its shot sleeve 34 filled with molten metal, in that the piston 36 has been completely retracted for this purpose. When the injector mechanism 30 is tilted into its full-line position shown in FIGS. 1 and 3, the shot sleeve 34 may be extended as shown in FIGS. 2 and 5. Once the shot sleeve 34 is seated in the docking block 44, the piston 36 ejects all the molten metal into the cavity of the dies 40 and 50 or 50' via the tapered trough duct 46 to form the casting 100 and the sprue 102 (see FIGS. 2, 5 through 8, and 10). Once the molten metal has solidified in the die cavity, the piston 36 and shot sleeve 34 are retracted into the oscillatable injection mechanism 30, and it may be rocked away into its dotted-line position ready for filling for the making of the next casting. Now the dies and casting are in the positin shown in FIG. 6 so that the movable die 50 or 50' can be opened or moved away from the stationary die 40 as shown in FIG. 7. After this operation the slides 60 and 80, as well as 70 and 90, may be retracted as shown in FIGS. 8, 9 and 10. Lastly, the ejector pins 54 are extended to remove the casting 100 and its sprue 102 from the die 50' as shown in FIG. 10.

Although the above operations were described as a series of steps, it was described only by way of an example, in that some of the steps may be performed in parallel or simultaneously with other steps without departing from the scope of this invention.

While there is described above the pinciples of this invention in connection with specific apparatus, it is to be clearly understood that this description is made only by way of example and not as a limitation to the scope of this invention.

I claim:

1. Dies for a horizontal die casting machine with a vertical injector, said dies comprising a stationary die with a parting surface, and a horizontally movable die with a parting surface adjacent said parting surface of said stationary die, said vertical injector moveable beneath said dies for injecting molten metal into said dies when said dies are closed, said injector having an axially upwardly movable shot sleeve at its upper end, the improvement comprising:

(A) a complete annular cylindrical docking block in said stationary die adjacent said parting surface of said stationary die near the lower portion of said stationary die, said block seating said shot sleeve when moved upwardly into said block, and (B) a trough duct from the upper open end of said block in said parting surface of said stationary die for conducting molten metal from said shot sleeve into said dies.

2. Dies according to claim 1 wherein said docking block projects out of said parting surface of said stationary die and wherein said parting surface of said movable die has a cavity for accurately fitting and receiving the projecting part of said docking block.

3. Dies according to claim 1 wherein said movable die includes a plurality of slides.

4. Dies according to claim 3 wherein said slides are opposing horizontal slides.

5. Dies according to claim 3 wherein said slides include a top vertical slide.

6. Dies according to claim 1 including a vertically movable slide on the lower parting surface of said movable die adjacent said docking block.

7. Dies according to claim 6 wherein said docking block projects out of said parting surface of said stationary die and wherein said slide has a cavity for said projecting part of said docking block.

8. Dies for a horizontal die casting machine with a vertical injector, said dies comrising a stationary die with a parting surface and a horizontal movable die with a parting surface adjacent the parting surface of said stationary die, said vertical injector movable beneath said dies for injecting molten metal into said dies when said dies are closed and their parting surfaces are together, said injector having a shot sleeve at its upper end, the improvement comprising:

(A) a vertically movable slide on the lower front of said movable die also having a parting surface adjacent the parting surface of said stationary die, (B) a docking block in said stationary die at its parting surface adjacent said slide, said block seating said shot sleeve projected into said block, and (C) a trough duct from said outer end of said block at said parting surface of said stationary die for conducting molten metal from said shot sleeve into said dies.

9. Dies according to claim 8 wherein said docking block is a complete annular bushing for seating engagement with said shot sleeve of said injector.

10. Dies according to claim 8 wherein said movable die includes a plurality of slides.

11. Dies according to claim 10 wherein said slides are opposing horizontal slides.

12. Dies according to claim 10 wherein said slides include a top vertical slide.

13. Dies for a horizontal die casting machine with a vertical injector, said dies comprising a stationary die with a parting surface, and a horizontally movable die with a parting surface adjacent said parting surface of said stationary die, said vertical injector oscillatable beneath said dies for injecting molten metal into said dies when said dies are closed, said injector oscillatable between a die injecting acute angle position on one side of the vertical and a molten metal filling acute angle position on the other side of the vertical, said injector having an axially upwardly movable shot sleeve at its upper end, the improvement comprising:

(A) a complete annular cylindrical docking block in said stationary die extending at said injecting angle from the bottom of said stationary die to the lower portion of said parting surface of said stationary die, the plane of the exposed upper end of said block being at said die injecting angle to said horizontal, said block seating said shot sleeve when moved upwardly at said die injecting acute angle into said block, and (B) a trough duct from the upper open end of said block in said parting surface of said stationary die for conducting molten metal from said shot sleeve into said dies.

14. Dies according to claim 13 wherein said docking block projects out of said parting surface of said stationary die and wherein said parting surface of said movable die has a cavity for accurately fitting and recieving the projecting part of said docking block.

15. Dies according to claim 14 wherein said movable die has a bottom vertical slide and wherein said cavity is in said bottom vertical slide.

16. Dies according to claim 13 wherein said movable die includes a plurality of slides.

17. Dies according to claim 16 wherein said slides are opposing horizontal slides.

18. Dies according to claim 16 wherein said slides include a top vertical slide.

19. Dies according to claim 13 including a vertically movable slide on the lower parting surface of said movable die adjacent said docking block.

20. Dies for a horizontal die casting machine with a vertical injector, said dies comprising a stationary die with a parting surface, and a horizontally movable die with a parting surface adjacent the parting surface of said stationary die, said vertical injector oscillatable beneath the dies for injecting molten metal into said dies when said dies are closed and their parting surfaces are together, said injector having a shot sleeve at its upper end, the improvement comprising:

(A) a vertically movable slide on the lower front of said movable die also having a parting surface adjacent the parting surface of said stationary die, (B) a docking block in said stationary die at its parting surface adjacent said slide, the plane of the outer end of said block being at an acute angle to the horizontal at the same acute angle that the shot sleeve is to the vertical, said block seating said shot sleeve projected into said block, and (C) a trough duct from said outer end of said block at said parting surface of said stationary die for conducting molten metal from said shot sleeve into said dies.

* * * * *